US009767774B2

(12) United States Patent
Lehrman et al.

(10) Patent No.: US 9,767,774 B2
(45) Date of Patent: Sep. 19, 2017

(54) SYNTHESIZER WITH CYMBAL ACTUATOR

(71) Applicant: Tufts University, Medford, MA (US)

(72) Inventors: Paul D. Lehrman, Medford, MA (US); Chris Penny, Cambridge, MA (US); Cody Chen, Wrentham, MA (US); Noel Hwang, Newton, MA (US); Robert White, Lexington, MA (US)

(73) Assignee: TUFTS UNIVERSITY, Medford, MA (US)

( * ) Notice: Subject to any disclaimer, the term of this patent is extended or adjusted under 35 U.S.C. 154(b) by 0 days.

(21) Appl. No.: 14/921,267

(22) Filed: Oct. 23, 2015

(65) Prior Publication Data

US 2017/0116971 A1 Apr. 27, 2017

(51) Int. Cl.

| | |
|---|---|
| ***G10H 3/10*** | (2006.01) |
| ***G10D 13/02*** | (2006.01) |
| ***G10D 13/06*** | (2006.01) |
| ***G10H 3/14*** | (2006.01) |

(52) U.S. Cl.

CPC ..... *G10D 13/024* (2013.01); *G10D 13/06* (2013.01); *G10H 3/10* (2013.01); *G10H 3/146* (2013.01); *G10H 2220/161* (2013.01); *G10H 2220/461* (2013.01); *G10H 2230/321* (2013.01); *G10H 2250/221* (2013.01); *G10H 2250/251* (2013.01)

(58) Field of Classification Search

CPC ..... G10H 3/10
USPC ..... 84/723, 737
See application file for complete search history.

(56) References Cited

U.S. PATENT DOCUMENTS

| | | | | |
|---|---|---|---|---|
| 5,262,585 | A * | 11/1993 | Greene | G10H 1/0066 84/645 |
| 8,729,378 | B2 | 5/2014 | Ryan et al. | |
| 9,245,510 | B2 * | 1/2016 | Truchsess | G10H 1/32 |
| 2005/0039593 | A1 * | 2/2005 | Wachter | G10H 3/146 84/730 |
| 2007/0131090 | A1 * | 6/2007 | Stannard | G10D 13/06 84/422.4 |
| 2008/0034946 | A1 * | 2/2008 | Aimi | G10H 3/146 84/604 |
| 2010/0180750 | A1 * | 7/2010 | Steele | G10H 1/32 84/422.3 |
| 2011/0056361 | A1 * | 3/2011 | Steele | G10H 1/348 84/422.3 |
| 2012/0048099 | A1 * | 3/2012 | Wissmuller | G10H 1/348 84/723 |
| 2012/0060670 | A1 * | 3/2012 | Truchsess | G10D 13/06 84/724 |
| 2012/0118130 | A1 * | 5/2012 | Field | G10H 3/146 84/730 |
| 2012/0144980 | A1 * | 6/2012 | Roderick | G10H 3/143 84/723 |
| 2013/0047826 | A1 * | 2/2013 | Wissmuller | G10H 3/00 84/723 |
| 2013/0312590 | A1 | 11/2013 | Truchsess | |

(Continued)

*Primary Examiner* — David Warren
(74) *Attorney, Agent, or Firm* — Occhiuti & Rohlicek LLP

(57) ABSTRACT

An apparatus for making music includes a cymbal, an acoustic transducer, a signal-processing system that receives a first signal from the acoustic transducer and that generates a second signal based on a property of the first signal, and a classifier that determines a particular manner in which the cymbal was struck based on the second signal, and provides an output trigger signal for triggering production of a sound that consistent with the particular manner.

23 Claims, 4 Drawing Sheets

(56) References Cited

U.S. PATENT DOCUMENTS

| | | | | |
|---|---|---|---|---|
| 2014/0298978 | A1* | 10/2014 | Yoshino | G10H 1/32 84/743 |
| 2015/0262567 | A1* | 9/2015 | Truchsess | G10H 1/32 84/725 |

* cited by examiner

SYNTHESIZER WITH CYMBAL ACTUATOR

FIELD OF INVENTION

This invention relates to musical instruments, and in particular, to musical instruments that produce synthesized sounds.

BACKGROUND

Many drummers have recognized that it is difficult to practice the drums at home because drums are quite loud. To remedy this problem, drummers have relied on electronic versions of a drum kit. Many of these electronic drum kits use rubber pads to simulate drums. These rubber pads have force sensors that sense when the pad has been struck, and how hard it has been struck.

In addition to drums, a typical drum kit also has cymbals. In the case of an electronic drum kit, these cymbals are replaced by rubber disks that are mounted on a pole in much the same way a real cymbal would be mounted. The rubber disk has force sensors like those used in the drums.

When practicing using an electronic drum set, the drummer usually wears headphones that are connected to an amplifier. When the drummer strikes a rubber pad, a corresponding sound is played out the amplifier so that the drummer has the illusion of playing a real drum. Similarly, when the drummer hits the rubber disk, a corresponding cymbal sound is played out the amplifier.

In an acoustic drum kit, the sound that a drum or cymbal makes depends to some extent on where it is hit. In the case of electronic drum kits, this variation in sound can be simulated by having multiple force sensors on the rubber pad. When the rubber pad is struck, the differential forces sensed at each sensor can be used to triangulate the likely position of the strike. With this position known, a corresponding sound can be played through the headphones.

The resulting system creates a fairly convincing simulation of a real drum kit, at least as far as the sense of hearing is concerned. However, there are difficulties with the drummer's haptic feedback. This is because the elements of an electronic drum kit do not feel quite like their acoustic counterparts.

For some elements, the difference is tolerable. For example, since a bass drum is played by foot pedal anyway, the fact that one is hitting a rubber pad is not so noticeable. For other drums, the difference is noticeable but tolerable. However, the rubber disk that masquerades as a cymbal is completely unconvincing. A suspended rubber disk simply does not feel even remotely like a cymbal.

One way to retain the feel of a cymbal while avoiding its excessive volume is to use a "deadened cymbal." A deadened cymbal is intended to feel like a real cymbal but to be much quieter.

One way to make a deadened cymbal is to perforate the cymbal's metal surface. Such perforated cymbals retain much of the feel of conventional cymbals, but without as much sound. Perforated cymbals provide good haptic feedback to the drummer.

Another way to make a deadened cymbal is to coat the perforated cymbal with a sound-deadening material to further reduce the volume. This compromises the haptic feedback somewhat. But the result is still far superior to a rubber disk.

A difficulty that arises is that a cymbal of this type is still an acoustic instrument. A drummer who is wearing headphones may not be able to hear the cymbal very well. In fact, since the cymbal was designed to be quiet, he may not hear it at all.

One solution to this problem is to do what is done with a singer's voice: use a microphone. Thus, one can place a microphone near the cymbal to generate an electronic analog signal that can be passed to the amplifier and mixed with the drum signals. The drummer will then be able to hear the cymbal through the headphones.

In the case of a singer, this solution works well, but only when the singer has a good voice to begin with. If the singer does not sound good, the end result is simply a louder version of an unpleasant voice.

The same problem arises in the case of a deadened cymbal. These cymbals do not sound nearly as good as the real thing. Although one can amplify the sound of a deadened cymbal, the result will just be a louder deadened cymbal. Since cymbals often play the role of an exclamation point in a musical composition, the whimper of a deadened cymbal trying to rise to the occasion by mere amplification can be unsatisfying.

It is possible, of course, to carry out some rudimentary signal processing procedures on the sound of a deadened cymbal. However, these techniques are best used to enhance something that already sounds reasonably good to begin with.

SUMMARY

One object of the invention is to provide a way to make a deadened cymbal both sound and feel like something that it is not. For example, one may want to make a deadened cymbal sound like a real cymbal. Or, one may want to make a deadened cymbal sound like another percussion instrument, such as a cowbell or a washboard. Or, one may wish to make the deadened cymbal sound like something completely different from a percussion instrument.

Another object of the invention is to enable a cymbal to function as an input for triggering emission of a sound. Such an input can be provided to a synthesizer that either retrieves and plays back pre-recorded sounds as output sounds or synthesizes an appropriate output sound on the spot. These output sounds might be cymbal sounds, sounds of other percussion instruments, sounds of pitched instruments, with different areas of the cymbal corresponding to different pitches, or various sound effects. The sounds might even be pre-recorded spoken syllables. In such a case, a cymbalist striking different portions of the cymbal could actually cause the synthesizer to output comprehensible speech. By hitting the cymbal harder or softer, the cymbalist might impart inflection to such synthesized speech, thus increasing its expressive power.

Another object of the invention is to enable a cymbal to function as an input for triggering emission of a sound. Such an input can be provided to a synthesizer that either retrieves and plays back pre-recorded sounds as output sounds or synthesizes an appropriate output sound on the spot. These output sounds might be cymbal sounds, sounds of other percussion instruments, sounds of pitched instruments, with different areas of the cymbal corresponding to different pitches, or various sound effects. The sounds might even be pre-recorded spoken syllables. In such a case, a cymbalist striking different portions of the cymbal could actually cause comprehensible speech to be output by the synthesizer. By hitting the cymbal harder or softer, the cymbalist might impart inflection to such synthesized speech, thus increasing its expressive power.

Although the invention is described in terms of a cymbal, it is applicable, in principle, to any percussion instrument.

In some embodiments, a signal received from a percussion instrument by a microphone is processed to obtain information concerning the manner in which the instrument was struck. Since the microphone's output is not intended to be heard directly, there is no reason to confine it to the audible range. The microphone and the processing steps carried out on the signal provided by the microphone can use information carried in frequencies beyond the range of hearing, such as frequencies in the ultrasonic range.

Information about the properties of the strike can include the intensity with which the percussion instrument is struck, the location in which it was struck, and any other properties of the strike.

An output carrying such information can then be represented as a MIDI signal and passed to a MIDI synthesizer or sample player.

In some embodiments, the invention provides a way to receive an acoustic signal from a cymbal or other percussion instrument and, based on that signal, select from among a set of pre-recorded sounds, a particular sound to be played.

In other embodiments, the invention provides a way to receive an acoustic signal from a cymbal or other percussion instrument and, based on that signal, cause synthesis of an output sound that corresponds to that signal.

In one aspect, the invention features an apparatus for making music. Such an apparatus includes a cymbal, an acoustic transducer, a classifier, and a signal-processing system that receives a first signal from the acoustic transducer, generates a second signal based on a property of the first signal, and provides the second signal to the classifier so that the classifier can determine a particular manner in which the cymbal was struck based on the second signal. The classifier then provides an output trigger signal for triggering production of a sound that is consistent with the particular manner.

In some embodiments, the property of the first signal is its power spectrum. Other properties of the first signal that can be used include its Hilbert transform, its Hilbert-Huang transform, and its wavelet transform.

In other embodiments, the cymbal includes a sound-deadening feature. As a result, when struck, the cymbal resounds with a volume that is lower than the cymbal would have had absent the sound-deadening feature. Among these embodiments are those in which the sound-deadening feature includes a perforated metal surface, and those in which the sound-deadening feature includes a solid material layered on a cymbal's metal surface.

Embodiments also include those having a resilient ring attached to the cymbal. The ring supports the acoustic transducer. As a result of the resiliency, the ring isolates the acoustic transducer from vibrations of the cymbal.

In other embodiments, the acoustic transducer is isolated from vibration of the cymbal.

Yet other embodiments include a cymbal-mounted transducer that provides a first signal to certain circuitry. The first signal is indicative of the cymbal having been struck. In these embodiments, the acoustic transducer provides a second signal to the same circuitry. This second signal is indicative of a sound wave incident thereon. The circuitry only outputs a third signal in response to receiving both the first and second signals. This arrangement suppresses the risk of mistakenly triggering a sound in response to receiving ambient sounds, such as from other cymbals.

In some embodiments, the acoustic transducer is configured to transmit, to the signal-processing system, signals containing frequencies beyond the acoustic range. Among these are embodiments in which the acoustic transducer transmits, to the signal-processing system, signals containing frequencies up to 30 kHz.

In some embodiments, the signal-processing system includes an inverse discrete cosine transform module that receives a filtered power spectrum of a windowed portion of the first signal and evaluates an inverse discrete cosine transform of the power spectrum and an inverse discrete wavelet transform module that receives a filtered power spectrum of a windowed portion of the first signal and evaluates an inverse discrete wavelet transform of the power spectrum.

Additional embodiments are those that also have a calibration table. In these embodiments, the classifier receives the second signal, which includes a measurement vector. The calibration table includes calibration vectors that populate a vector space. Based on the calibration vectors, the classifier identifies a region of the vector space that corresponds to the measurement vector.

In some embodiments, the classifier is configured to determine a first distance, which is a distance between the measurement vector and a first calibration vector, and a second distance, which is a distance between the measurement vector and a second calibration vector. The second distance is greater than the first. These calibration vectors are associated with corresponding first and second regions, or "keys," in the vector space. In a first embodiment, the classifier associates the measured vector with the second region. But in a second embodiment, the classifier associates the measured vector with the first region.

In the case of the above second embodiment, the vector space includes a first cluster-mate set and a second cluster-mate set. These sets include calibration vectors that have been designated as cluster-mates of the first and second calibration vectors respectively. The classifier calculates first and second average distances. The first average distance is an average of distances between the measured vector and each calibration vector in the first cluster-mate set, while the second average distance is an average of distances between the measured vector and each calibration vector in the second cluster-mate set. In the case of the second embodiment, the first average distance is greater than the second average distance. However, in the case of the first embodiment, this relationship is reversed. It is instead the second average distance that is the greater of the two.

Among the embodiments are those in which the classifier is configured to determine a location at which the cymbal was struck based on the second signal.

Yet other embodiments further include a trigger that receives the trigger signal. This trigger identifies, based on the trigger signal, information representative of a particular sound to be played. Among these embodiments are those in which the information representative of a particular sound to be played includes data representing the sound, those in which the information representative of a particular sound to be played includes information from which sound can be synthesized, and those in which the particular sound to be played is the sound a different cymbal would have made had the different cymbal been struck in the particular manner.

Also included within the scope of the invention are combinations of any and all of the foregoing embodiments.

In another aspect, the invention features a method of playing music. Such a method includes receiving a first signal from an acoustic transducer, the first signal being representative of a sound of a stricken cymbal, the cymbal having been struck in a particular manner, generating a second signal based on a property of the first signal, and based on the second signal, and generating a trigger signal to cause emission of a sound corresponding to the particular manner in which the cymbal was struck.

In some practices, the property of the first signal is a power spectrum of the first signal.

Among the foregoing practices are those in which the trigger signal causes emission of a sound that would have been made by a different cymbal had the different cymbal been struck in the same manner as the stricken cymbal.

An apparatus according to the invention is intended to be tangible and made of matter. 'For example, the signal-processing component and classification components are data processing devices made of electronic engineering materials with supporting mechanical components. These devices transform acoustic pressure waves in the adjacent air and structural vibrations in the acoustic materials into electronic signals and back again using electroacoustic transduction materials such as, but not limited to, piezoelectric materials. To the extent the words of the claim are construed to cover incorporeal embodiments or embodiments that are software per se, those particular embodiments are hereby excluded from claim scope.

The claimed method likewise results in transformation of matter as a result of moving charged particles within a processing device. To the extent that the claimed method might be construed as covering practices of the invention that are abstract, those particular practices are disclaimed.

Applicant, acting as his own lexicographer, hereby defines the words of the claims in combination as covering only those embodiments and practices that comply with the requirements of 35 USC 101 as of the filing date of this application.

BRIEF DESCRIPTION OF THE DRAWINGS

These and other features of the invention will be apparent from the following detailed description and the accompanying figures, in which.

DETAILED DESCRIPTION

Figure 1:
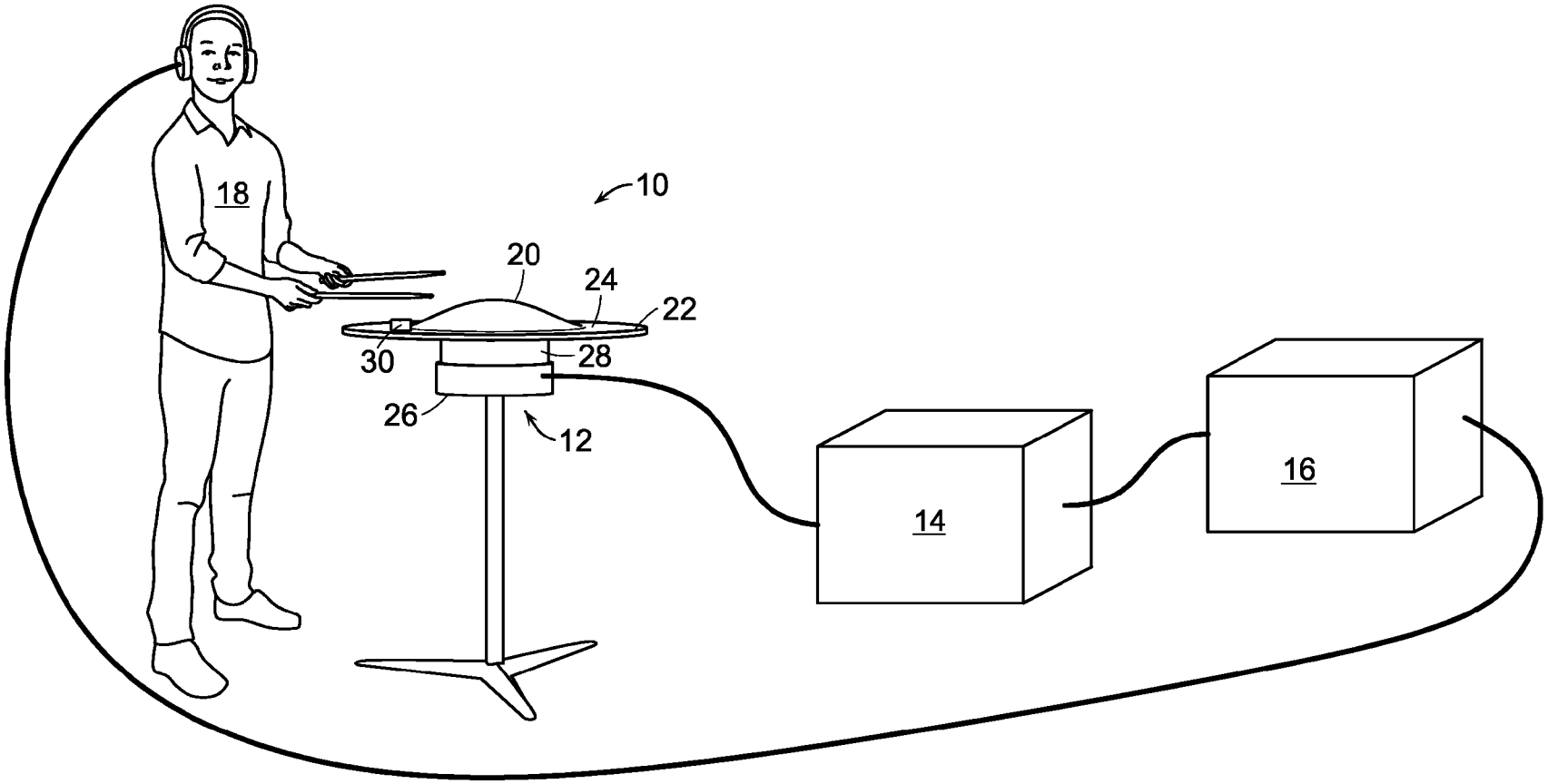
FIG. 1 shows an apparatus for producing a sound based on a cymbal-strike.

FIG. 1 shows a deadened cymbal 10 with an acoustic transducer 12 for collecting sound for further processing by a first subsystem 14. The first subsystem 14 provides, to a second subsystem 16, a processed signal that contains information indicative of a manner in which a cymbalist 18 has struck the deadened cymbal 10. The second subsystem 16 then plays a sound corresponding to the manner in which the deadened cymbal 10 was struck. A set of strike properties defines the manner in which the cymbal was struck.

The deadened cymbal 10 is divided into three cymbal regions: a bell 20, which surrounds the cymbal's center, an edge 22, which surrounds its periphery, and a bow 24 between the bell 20 and the edge 22. The sound that the deadened cymbal 10 makes depends on many things, such as how hard it is struck, and the manner in which it is struck. However, the sound depends a great deal on which of these three cymbal regions 20, 22, 24 is struck. Thus, among the elements of the set of strike properties is information identifying a location at which the deadened cymbal 10 was struck.

The acoustic transducer 12 includes a resilient ring 26 that is attached to the deadened cymbal 10. In some embodiments, the resilient ring 26 is attached with adhesive. In the case of a perforated cymbal, the holes in the deadened cymbal 10 itself can be used to bolt the resilient ring 26 to the deadened cymbal 10.

The resilient ring 26 supports and isolates a microphone 28. Preferably, the resilient ring 26 supports the microphone 28 so that it is very close to the deadened cymbal 10. In some embodiments, the distance is on the order of only 2 mm. The microphone 28 is a high-bandwidth microphone with a frequency response that extends beyond the acoustic range. In a particular embodiment, the microphone 28 has a bandwidth that extends up to at least 30 kHz. An example of a suitable microphone is a MEMs microphone.

Some embodiments include a microphone array instead of a single microphone 28. Other embodiments include a piezoelectric transducer 30 mounted directly on the deadened cymbal 10. This is useful because the microphone 28 will inevitably pick up ambient sounds, including possibly sounds from another cymbal in the drum set, whereas the piezoelectric transducer 30 will not. As a result, it is possible for the signal-processing system 14 to discriminate between a sound that comes from the deadened cymbal 10 being struck and sounds from other components of the drum set.

Although FIG. 1 shows the microphone 28 placed near the bell 20, this is not, in principle, necessary. The signal-processing methods described herein are agnostic to the location of the microphone 28. However, it has been found that placing the microphone 28 very near the bell 20 makes it easier to identify, from the sound, where the cymbalist struck the deadened cymbal 10.

Figure 2:
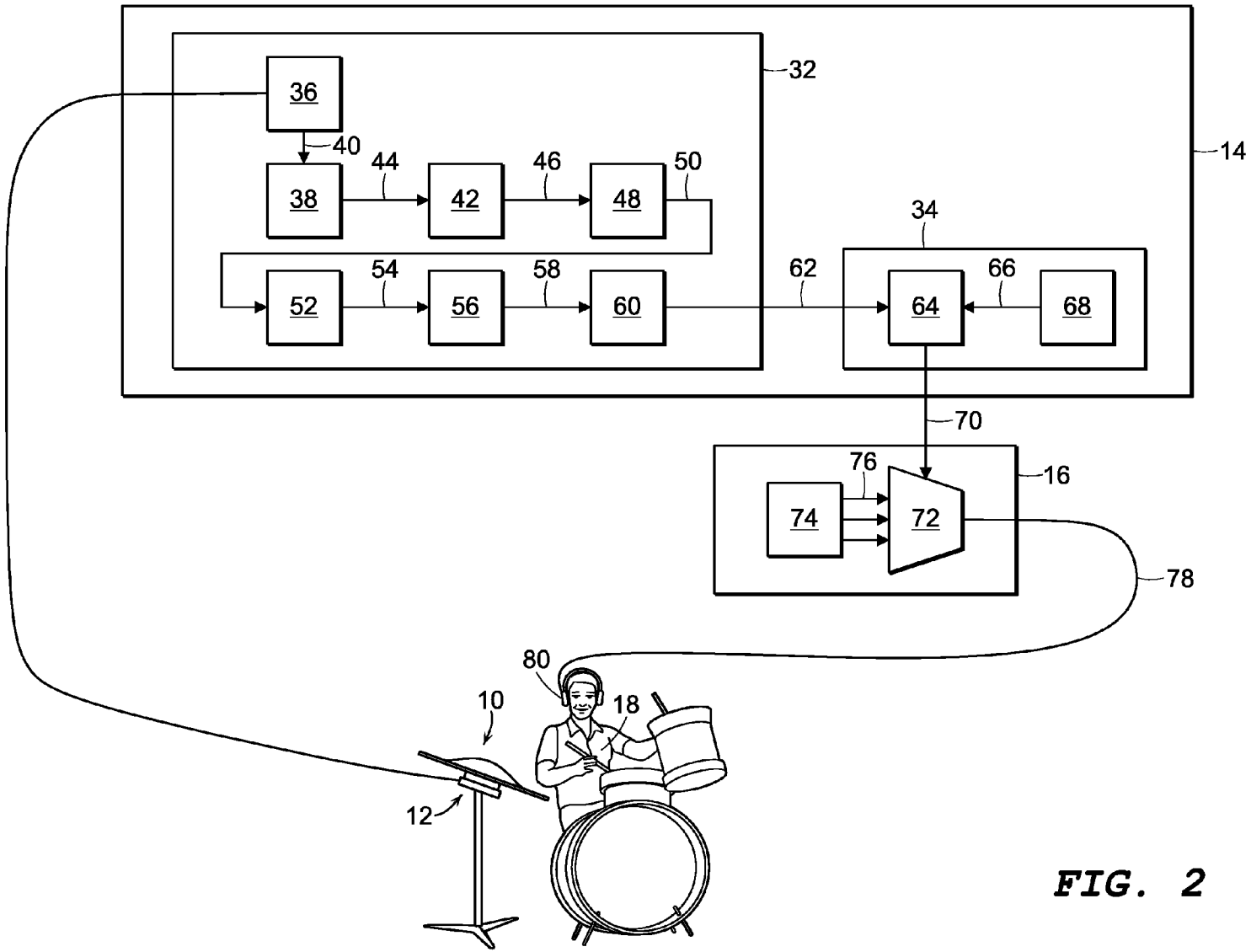
FIG. 2 shows details of the first and second subsystems shown in FIG. 1.

Referring now to FIG. 2, the first subsystem 14 includes a signal-processing section 32 and a classification section 34.

The signal-processing section 32 features a buffer memory 36 that constantly receives data from the acoustic transducer 12. A windowing module 38 with access to the buffer memory 36 monitors the buffer memory 36 in an effort to detect the occurrence of a strike. In one embodiment, such detection takes the form of detecting an impulse in an incoming signal from the transducer 12.

Upon detecting that the deadened cymbal 10 has been struck, the windowing module 38 recovers, from the buffer memory 36, time-domain data 40 indicative of the strike from a finite interval of time that begins either at the strike or slightly before the strike.

The extent of the window is selected to provide sufficient data for reliably determining where the deadened cymbal 10 was struck, but to avoid being long enough to compromise the ability of the system as a whole to provide an audio output within a time constant that is based on musical tempo. Given constraints of current hardware, a window on the order of two milliseconds wide with a sampling rate of 200 kHz has been found to be particularly useful.

A first filter 42 receives a windowed signal 44 from the windowing module 38 and filters it in the time domain. The resulting filtered window signal 46 is then provided to a power spectrum generator 48.

The power spectrum generator 48 transforms the filtered window signal 46 into a power spectrum 50. This power spectrum 50 is then provided to a second filter 52, which filters the series of samples in frequency and outputs a filtered power spectrum 54.

The filtered power spectrum 54 from the second filter 52 is then provided to an inverse-transform module 56, which carries out an inverse transform on the filtered power spectrum 54. In some embodiments, the inverse-transform module 56 implements an inverse discrete wavelet transform, whereas in other embodiments, it implements a discrete cosine transform. In either case, the result is a series of m inverse transform coefficients 58. The set of inverse transform coefficients 58, which represents the resulting inverse transform, is then filtered at a third filter 60. The resulting filtered inverse transform 62 is a vector to be provided to the classification section 34. For convenience of discussion, this vector will be referred to as the "measured vector" 62.

In a preferred embodiment, the first filter 42 is a bandpass filter having a passband extending from 150 Hz to 75 kHz. The second filter 52 is a low-pass filter having a cut-off frequency of 30 Hz, and the third filter 50 is a lowpass lifter with a cutoff at 400 seconds in quefrency space.

In one embodiment, the power spectrum generator 48 receives a spectrum $Y(\omega)$ and outputs a power spectrum $|Y(\omega)|^2$. The received spectrum $Y(\omega)$ is the product of the spectrum of the cymbal's impulse response, $F(\omega)$ and the spectrum of the forcing function associated with the cymbal-strike, $X(\omega)$. To recover information about the original cymbal-strike, one must disentangle these two spectra. This requires knowing the spectrum of the cymbal's impulse response so that it can ultimately be deconvolved from the output to recover the original forcing function.

In another embodiment, the power spectrum generator 48 instead outputs a power spectrum log $(|F(\omega)|^2)$. In such cases, the output of the inverse transform module 56 is effectively a power cepstrum. This is advantageous because once the spectrum of the cymbal's impulse response is known, one can simply perform a subtraction to recover the spectrum of the original forcing function. This can be done much more quickly.

In principle, it is possible to replace the power spectrum generator 48 with another module that provides some other property of a signal. These include a wavelet transform generator, a Hilbert transform generator, and a Hilbert-Huang transform generator.

The measured vector 62 identifies a location in an n-dimensional vector space. The vector space can be divided into regions. For reasons that will be apparent below, each region will be referred to as a "key."

Each key corresponds to the sound made by the deadened cymbal 10 when struck in a particular way. Since the measured vector 62 identifies a point in the vector space, it should, in principle, be able to identify the manner in which the deadened cymbal 10 was struck. All that is missing is a mapping that associates each key in the vector space with a corresponding set of strike properties. Once this mapping is known, it is possible to associate the measured vector 62 with a property-set that defines one or more strike properties. Each property-set can then be associated with an arbitrary sound to be synthesized.

The classification section 34 includes a classifier 64 that receives both the measured vector 62 and calibration vectors 66 stored in a calibration table 68. In a manner described below, the classifier 64 identifies the property-set that is most likely to correspond to the measured vector 62 and uses that information as a basis for sending a selection signal 70 to the second subsystem 16.

Within the second subsystem 16, a trigger 72 connects to a sound library 74 that provides information indicative of selected sounds 76. The information indicative of selected sounds 76 can be data representing pre-recorded sounds. However, information indicative of selected sounds 76 can also include information used to generate a sound on the fly.

The trigger 72 receives the selection signal 70 from the first subsystem 14. Based on the selection signal 70, the trigger 72 selects one of the selected sounds 76 from the sound library 74 and provides that as a speaker signal 78 to a speaker 80. As shown in FIG. 2, the speaker 80 is part of a pair of headphones. However, the speaker 80 can also be a loudspeaker used in a performance to provide sound for an audience.

Figure 3:
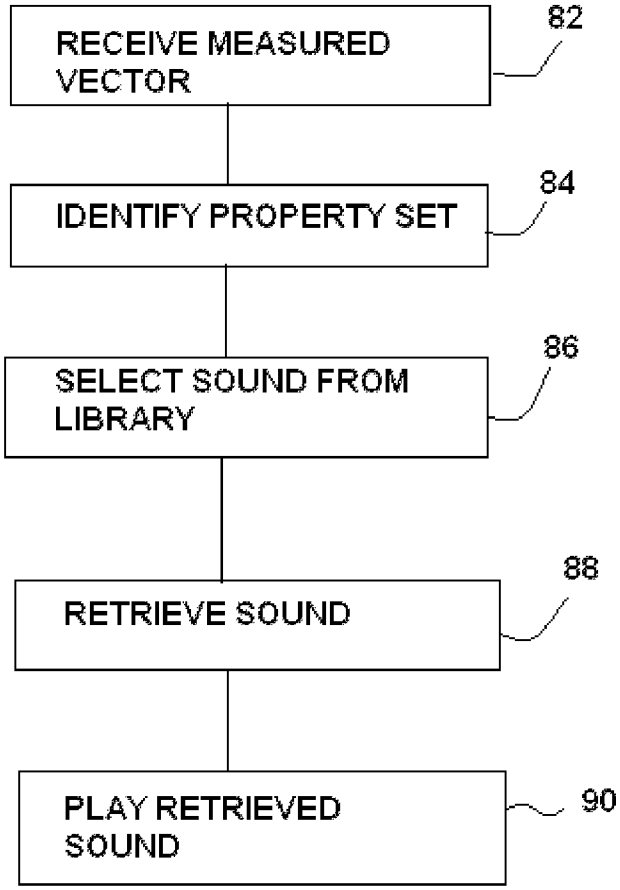
FIG. 3 shows a method carried out by the apparatus of FIG. 1.

Referring to FIG. 3, in operation, the classifier 64 receives a measured vector 62 (step 82) and determines, based on the key identified in the vector space, which property-set that particular measured vector 62 is most likely to correspond to (step 84). Then, having determined the property-set, the classifier 64 sends the selection signal 70 (step 86) to select, from the sound library 74, the particular sound that is associated with that property-set. Having done so, it retrieves the sound (step 88) and plays it (step 90). The result, in effect, is that the second subsystem 16 functions as a sound synthesizer that is controlled by how a deadened cymbal 10 is struck, rather than which key on a keyboard is pressed.

In effect, each region in the vector space corresponds to a virtual key. Stated more generally, the overall result is synthesizer that is controlled by an acoustic signal rather than by a digital signal from a keyboard. The deadened cymbal 10 is therefore a "cymbal actuator" for this synthesizer.

The sound that a particular region, or key, corresponds to is arbitrary. One application is to arrange the sounds so that they correspond to what a solid cymbal would have sounded like had it been hit in the manner corresponding to the property-set. In that case, the cymbalist would play on the deadened cymbal 10 and hear the sound that a solid cymbal would have made had it been struck the same way. In this application, the system acts as a cymbal simulator.

However, in principle there is no need for the system to simulate a cymbal. For example, the sound library 74 could maintain a library of sounds associated with other percussion instruments. Thus, a drummer could strike a deadened cymbal 10 one way to create a cow-bell sound and another way to create a wooden block sound.

The sound library 74 could also maintain sounds from a pitched instrument, such as a piano. The regions, or virtual keys would then be mapped to particular piano sounds. In this case, the cymbalist would be able to play a melody line. The resulting apparatus would then have the effect of transforming an instrument of indefinite pitch into one with a definite pitch. Although the application described herein is for the cymbal, the methods and apparatus described herein are applicable to mapping any acoustic signal in much the same way.

A difficulty that arises is that of reliably determining the particular key that a cymbal-strike corresponds to (step 84). In some practices, this is carried out by populating the calibration table 68 with calibration vectors 66 that correspond to particular keys and reliably classifying a measured vector 62 into one of those keys.

The calibration table 68 corresponds to a particular deadened cymbal 10. To generate the calibration table 68, the deadened cymbal 10 is repeatedly struck at a known location. The resulting sound is then passed through the signal-processing section 32 shown in FIG. 2. Each strike thus generates a calibration vector 66 that is comparable to the measured vector 62. Since the properties of the strike that led to the calibration vector 66 are known, then to the extent the measurement and calibration vectors 66 are similar, one can infer that the measured vector 62 arose from a strike having similar properties.

Thus, if one strikes the deadened cymbal 10 on the bell 20 m times, one will have m separate calibration vectors 66, each of which is associated with a particular type of cymbal-strike. Of course, these calibration vectors 66 will not be identical. If they were, there would be no point in collecting m of them. The purpose of collecting so many is to clearly demarcate a region in the vector space that corresponds to that type of cymbal-strike.

The classifier 64 then takes a measured vector 62 and compares it with the calibration vectors 66. This can be carried out by calculating a Euclidean distance between the measured vector 62 and each of the calibration vectors 66, finding the minimum such distance, identifying the calibration vector 66 associated with that minimum distance, identifying the key associated with that calibration vector 66, and then playing the sound associated with that key. However, this procedure is inefficient and can result in errors arising from outliers.

Figure 4:
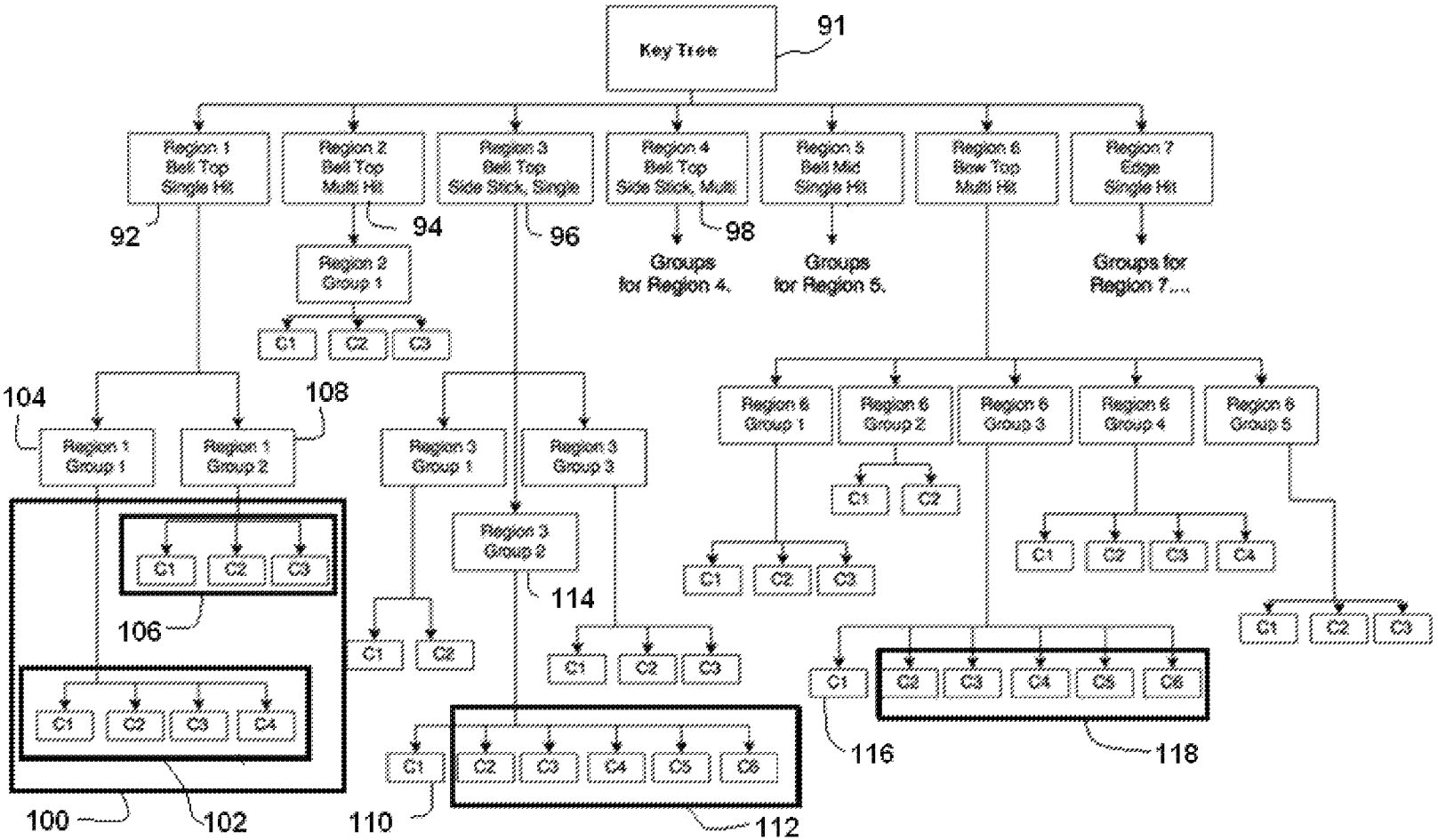
FIG. 4 shows a data structure of a calibration table maintained by the apparatus of FIG. 1.

To provide a more efficient classification method the calibration table 68 is organized into a hierarchical key tree 91 as shown in FIG. 4.

As shown in FIG. 4, the top level of the hierarchy consists of the keys, each of which corresponds to a property-set. For example, a first key 92 is one in which the deadened cymbal 10 was hit on its bell 20 once. A second key 94 is one in which the deadened cymbal 10 was hit on its bell 20 more than once. This distinction is necessary because the sound that the deadened cymbal 10 makes when struck depends in part on whether it has already been hit recently. This is because each cymbal-strike generates a certain amount of ringing that dies away slowly. As a result, the sound of a deadened cymbal 10 that has been struck shortly after a preceding cymbal strike will have this ringing added to it. The third and fourth keys 96, 98 are analogous to the first and second keys 92, 94 except that the deadened cymbal 10 has been struck using a side-stick technique.

The calibration process includes classifying calibration vectors 66 into groups, or clusters. Each cluster belongs to a particular key. The calibration vectors 66 within a cluster are selected such that the Euclidean distance between any two such calibration vectors 66 is less than a selected cluster radius. Each cluster has a centroid that is defined by the set of calibration vectors 66 within it. The centroids of different clusters may be relatively far apart even though the clusters themselves all belong to the same key.

This phenomenon is apparent from FIG. 4. For example, in building the illustrated calibration table 68, a drummer struck a deadened cymbal 10 on its bell 20 seven times to generate seven calibration vectors 100. Four of these calibration vectors 102 turned out to be fairly close to each other, and were thus grouped into a first cluster 104. These four vectors 102 are thus "cluster-mates."

The remaining three calibration vectors 106 were also close to each other. These three calibration vectors 106 thus become cluster-mates in a second cluster 108. The first and second clusters 104, 108, however, may be nowhere near each other in the vector space. Yet, because there exists a priori knowledge that these clusters 104, 108 were both generated the same way, they must be assigned to the same first key 92.

To reduce the likelihood of misclassification, if a measured vector 62 is found to be close to a first calibration vector 110, it is then compared to that first calibration vector's cluster-mates 112. If it is also reasonably similar to the first calibration vector's cluster-mates 112, then there exists a reasonable degree of certainty that the measured vector 62 truly belongs to a cluster 114 associated with that first calibration vector 110 and its cluster-mates 112.

On the other hand, if the measured vector 62 is nothing like the first calibration vector's cluster-mates 112, then the resemblance between the first calibration vector 110 and the measured vector 62 is ignored. In that case, attention shifts to a second calibration vector 116. The second calibration vector 116 has the property that a distance between the second calibration vector 116 and the measured vector 62 is less than the distance between the measured vector 62 and any vector in the set that includes all calibration vectors 66 except for the first and second calibration vectors 110, 116.

The procedure is then repeated until a suitable calibration vector 116 has been found. A suitable calibration vector 116 is one that is closer to the measured vector than any other calibration vector 66 and that has cluster-mates 118 that have an average distance from the measured vector 62 that is within a threshold.

Having described the invention, and a preferred embodiment thereof, what is claimed as new, and secured by letters patent is:

The invention claimed is:

1. An apparatus for making music, said apparatus comprising a cymbal, an acoustic transducer, a signal-processing system, a classifier, a cymbal-mounted transducer, and first circuitry, wherein said signal-processing system is configured to receive a first signal from said acoustic transducer, to generate a second signal based on a property of said first signal, and to provide said second signal to said classifier, wherein said classifier is configured to determine a particular manner in which said cymbal was struck based on said second signal, wherein said classifier is further configured to provide an output trigger signal for triggering production of a sound that is consistent with said particular manner, wherein said cymbal-mounted transducer provides a fourth signal to said first circuitry, said fourth signal being indicative of said cymbal having been struck, wherein said acoustic transducer provides a fifth signal to said first circuitry, said fifth signal being indicative of a sound wave incident thereon, and wherein said first circuitry only outputs a third signal in response to receiving both said fourth signal and said fifth signal.

2. The apparatus of claim 1, further comprising a ring wherein said ring is attached to said cymbal, wherein said ring is made of a resilient material, and wherein said ring supports said acoustic transducer, whereby said ring isolates said acoustic transducer from vibrations of said cymbal.

3. The apparatus of claim 1, wherein said classifier is configured to determine a location at which said cymbal was struck based on said second signal.

4. The apparatus of claim 1, further comprising a trigger that receives said trigger signal, wherein said trigger is configured to identify, based on said trigger signal, information representative of a particular sound to be played.

5. The apparatus of claim 4, wherein said particular sound to be played is the sound a different cymbal would have made had said different cymbal been struck in said particular manner.

6. The apparatus of claim 1, wherein said property of said first signal comprises a power spectrum of said first signal.

7. An apparatus for making music, said apparatus comprising a cymbal, an acoustic transducer, a signal-processing system, and a classifier, wherein said signal-processing system is configured to receive a first signal from said acoustic transducer, to generate a second signal based on a property of said first signal, and to provide said second signal to said classifier, and wherein said classifier is configured to determine a particular manner in which said cymbal was struck based on said second signal, and wherein said classifier is further configured to provide an output trigger signal for triggering production of a sound that consistent with said particular manner, wherein said signal-processing system comprises a module selected from the group consisting of an inverse discrete cosine transform module that receives a filtered power spectrum of a windowed portion of said first signal and evaluates an inverse discrete cosine transform of a power spectrum of said first signal and an inverse discrete wavelet transform module that receives a filtered power spectrum of a windowed portion of said first signal and evaluates an inverse discrete wavelet transform of said power spectrum.

8. The apparatus of claim 7, wherein said acoustic transducer is isolated from vibration of said cymbal.

9. The apparatus of claim 7, wherein said acoustic transducer is configured to transmit, to said signal-processing system, signals containing frequencies beyond the acoustic range.

10. The apparatus of claim 7, wherein said signal-processing system comprises said inverse discrete wavelet transform module.

11. The apparatus of claim 7, wherein said signal-processing system comprises said inverse discrete cosine transform module.

12. The apparatus of claim 7, further comprising a ring wherein said ring is attached to said cymbal, wherein said ring is made of a resilient material, and wherein said ring supports said acoustic transducer, whereby said ring isolates said acoustic transducer from vibrations of said cymbal.

13. The apparatus of claim 7, wherein said classifier is configured to determine a location at which said cymbal was struck based on said second signal.

14. The apparatus of claim 7, further comprising a trigger that receives said trigger signal, wherein said trigger is configured to identify, based on said trigger signal, information representative of a particular sound to be played.

15. The apparatus of claim 14, wherein said particular sound to be played is the sound a different cymbal would have made had said different cymbal been struck in said particular manner.

16. The apparatus of claim 7, wherein said property of said first signal comprises a power spectrum of said first signal.

17. An apparatus for making music, said apparatus comprising a calibration table, a cymbal, an acoustic transducer, a signal-processing system, and a classifier, wherein said signal-processing system is configured to receive a first signal from said acoustic transducer, to generate a second signal based on a property of said first signal, and to provide said second signal to said classifier, and wherein said classifier is configured to determine a particular manner in which said cymbal was struck based on said second signal, wherein said classifier is further configured to provide an output trigger signal for triggering production of a sound that consistent with said particular manner, wherein said classifier is configured to receive said second signal, wherein said second signal comprises a measurement vector, wherein said calibration table comprises calibration vectors that populate a vector space, wherein, based on said calibration vectors, and wherein said classifier is configured to identify a region of said vector space that corresponds to said measurement vector.

18. The apparatus of claim 17, wherein said classifier is configured to determine a first distance and a second distance, wherein said first distance is a distance between said measurement vector and a first calibration vector wherein said second distance is a distance between said measurement vector and a second calibration vector, wherein said first calibration vector is associated with a first region of said vector space, wherein said second calibration vector is associated with a second region of said vector space, wherein said first distance is greater than said second distance, and wherein said classifier is configured to associate said measured vector with said first region of said vector space.

19. The apparatus of claim 18, wherein said vector space comprises a first cluster-mate set and a second cluster-mate set, wherein said first cluster-mate set comprises calibration vectors that have been designated as cluster-mates of said first calibration vector, wherein said second cluster-mate set comprises calibration vectors that have been designated as cluster-mates of said second calibration vector, wherein said classifier is configured to calculate a first average distance and a second average distance, wherein said first average distance is an average of distances between said measured vector and each calibration vector in said first cluster-mate set, wherein said second average distance is an average of distances between said measured vector and each calibration vector in said second cluster-mate set, and wherein said first average distance is greater than said second average distance.

20. The apparatus of claim 17, further comprising a ring wherein said ring is attached to said cymbal, wherein said ring is made of a resilient material, and wherein said ring supports said acoustic transducer, whereby said ring isolates said acoustic transducer from vibrations of said cymbal.

21. The apparatus of claim 17, further comprising a trigger that receives said trigger signal, wherein said trigger is configured to identify, based on said trigger signal, information representative of a particular sound to be played.

22. The apparatus of claim 21, wherein said particular sound to be played is the sound a different cymbal would have made had said different cymbal been struck in said particular manner.

23. The apparatus of claim 17, wherein said property of said first signal comprises a power spectrum of said first signal.

* * * * *